US005115529A

United States Patent [19]

White

[11] Patent Number: 5,115,529

[45] Date of Patent: May 26, 1992

[54] SUPPORT FOR SELECTIVELY SEATING AND DEVELOPING BALANCE AND MOTOR CONTROL IN INFANTS

[76] Inventor: Judy I. White, 2608 Kingsgrove Cres., Ottawa, Ontario, Canada, K1J 6G1

[21] Appl. No.: 784,543

[22] Filed: Oct. 29, 1991

[51] Int. Cl.[5] ..... A47D 1/00; A47D 13/00; A47D 13/08

[52] U.S. Cl. ..... 5/655; 5/633; 297/443

[58] Field of Search ..... 5/431, 432, 434, 436, 5/448, 465, 437; 297/443

[56] References Cited

U.S. PATENT DOCUMENTS

| | | | |
|---|---|---|---|
| 1,769,722 | 7/1930 | Sutton . | |
| 2,404,505 | 7/1946 | Knecht | 5/432 |
| 2,710,052 | 6/1955 | Witmer | 297/459 |
| 3,840,916 | 10/1974 | Jennings | 5/431 |
| 4,441,221 | 4/1984 | Enste et al. | 5/431 |
| 4,538,310 | 9/1985 | Scott | 5/432 |
| 4,667,356 | 5/1987 | Holmquist | 5/431 |
| 4,980,937 | 1/1991 | Mason et al. | 5/432 |
| 5,035,015 | 7/1991 | Maietta | 5/431 |

FOREIGN PATENT DOCUMENTS

| | | | |
|---|---|---|---|
| 2401641 | 4/1979 | France | 5/432 |

*Primary Examiner*—Alexander Grosz
*Attorney, Agent, or Firm*—Thomas R. Vigil; James P. Hanrath

[57] ABSTRACT

A support for selectively seating and protecting an infant while developing balance and motor control in a seating position comprises a free standing support body having a substantially planar base, front, rear and opposed side surfaces. The front surface includes a backrest portion which is inclined at an acute angle with respect to the base and spaced-apart side arms which extend forwardly in the plane of the base from opposite sides of the front surface. The support body has sufficient weight and stability to inhibit movement or tipping of the support body. A seat cushion is independent of the support body and is attachable thereto in a first position and a second position. In the first position, the seat cushion combines with the support body to form a rearwardly inclined infant seat having a seat surface formed by a top surface of the seat cushion and a backrest surface formed by the backrest portion of the support body. In the second position, the seat cushion is remote from the backrest portion to provide a space enclosed at the rear by the backrest portion of the support body, at the sides by the opposed side arms, and at the front by the seat cushion. This space is adequate to accommodate an infant in a substantially unsupported sitting position for developing balance and motor control while providing a surrounding cushion to help prevent injury due to a fall in any direction from a seating position within the surrounding cushion. The side arms may also be provided with touch and sound toys which are either built into the support or firmly attachable thereto.

12 Claims, 4 Drawing Sheets

SUPPORT FOR SELECTIVELY SEATING AND DEVELOPING BALANCE AND MOTOR CONTROL IN INFANTS

The present invention relates to apparatus for supporting infants in a sitting position, and in particular to a support which is designed to provide in a first configuration a seat for securely supporting an infant in a sitting position and, in a second configuration a protective surround to protect an infant as it develops balance and motor control in a substantially unsupported sitting position.

BACKGROUND OF THE INVENTION

Seats, supports and cushions for supporting infants in sitting or reclining positions are well known and widely used. Known articles of this type are taught in at least the following U.S. Pat. Nos.: 1,769,722—Sutton; 4,441,221—Enste et al; 2,404,505—Knecht; 4,538,310—Scott; 3,840,916—Jennings; 4,667,356—Holmquist.

An object of the prior art references listed above, as explicitly or implicitly stated in each, is to securely support an infant in at least one of a sitting or reclining position. Although such supports fulfill a definite need, they are not designed to contribute to the development of balance or muscular control in infants.

An average infant commences a process of learning to sit up unaided at approximately six months of age. This learning process continues for four to six months. During this interval, an infant is advantageously provided with a relatively secure environment which permits the infant to practice sitting in a upright position while providing the infant with a cushioned surround for protecting the infant's head when it falls from a sitting position. Mothers have traditionally provided this environment by surrounding a child with rolled up blankets, pillows, cushions and related paraphernalia available in the home environment. Although these make-do arrangements generally provide adequate protection, they are usually unattractive and require a lot of maintenance. In addition, it is necessary and desirable to have a seat for securely supporting an infant in a sitting position since an infant, especially in the early stages of development, cannot sit unaided for long periods of time. It is therefore necessary to have an infant seat which will support the infant in a seated position as well the paraphernalia required to permit an infant to sit unaided.

SUMMARY OF THE INVENTION

It is an object of the invention to provide a support for selectively seating and protecting an infant while developing balance and motor control.

It is a further object of the invention to provide a support which includes touch and sound toys for stimulating the sensory development of infants.

In accordance with the invention there is provided a support for selectively seating and protecting an infant while developing balance and motor control in a sitting position which comprises in combination, a free standing support body having a substantially planar base, front, rear and opposed side surfaces, the front surface including a back rest portion which is inclined at an acute angle with respect to the base, and spaced-apart side arms which extend forwardly in the plane of the base from opposed sides of the front surface, said support body further including means for the lending weight and stability thereto to inhibit movement of the support body on a surface as well as to inhibit tipping of the support body; and a seat cushion which is substantially triangular in cross-section said cushion being independent of the support body but attachable thereto in at least a first position wherein the support cushion, in combination with the support body, forms a rearwardly inclined infant seat having a seat surface formed by a top surface of the seat cushion and a backrest surface formed by the backrest portion of the support body, and a second position remote from the backrest portion to provide a space enclosed at the rear by the backrest portion of the support body, at the sides by the opposed side arms and at the front by the seat cushion, said space being adequate to accommodate an infant in a substantially unsupported sitting position for developing balance and motor control while providing a surrounding cushion to help prevent injury due to a fall in any direction from a sitting position within the surrounding cushion.

The side arms of the support in accordance with the invention are also preferably provided with touch and sound toys which are either built in to the support of firmly attachable thereto. The touch and sound toys must, of course, be soft and pliable so as not to constitute a hazard for a falling infant. The support in accordance with the invention may be manufactured from a variety of materials including molded polyurethane foam, a fiber or particle filled cloth or plastic form, or an inflatible plastic form which may be deflated for storage or transport. The free-standing support body must include enough weight adjacent the base to inhibit it from sliding about on a surface and to inhibit it from tipping over. The base of the free-standing support body should also be covered in a slide resistant material to inhibit movement of the body across most surfaces.

BRIEF DESCRIPTION OF THE DRAWINGS

The invention will now be described by way of example only and with reference to the following drawings wherein.

DESCRIPTION OF THE PREFERRED EMBODIMENT

Figure 1:
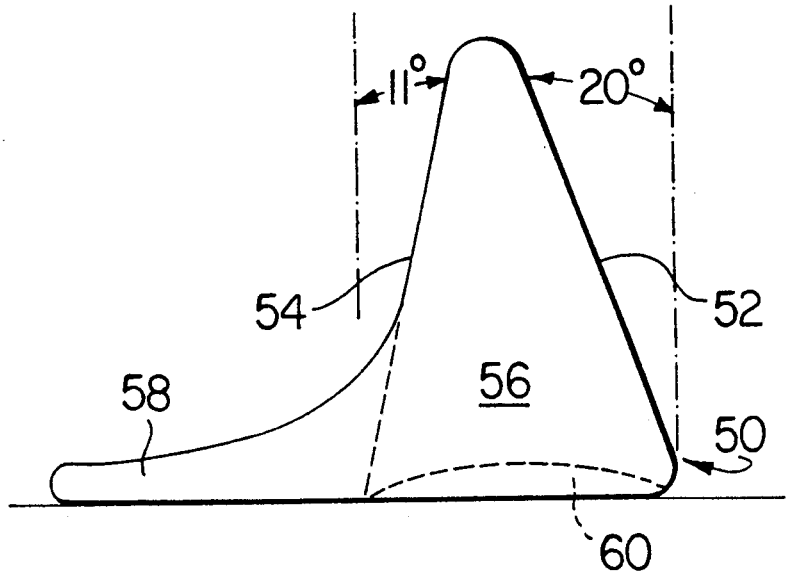
FIG. 1 is a side elevational schematic view of the free-standing support body in accordance with the invention.

As shown in FIG. 1, the invention includes a free-standing support body 50 having a rear surface 52, a front surface 54, opposed side surfaces 56, and forwardly extending spaced-apart arms 58. The body further includes an internal sealed compartment 60 which encases a weighty preferably granular material such as sand or gravel for lending weight and stability to the free-standing support body.

As shown in FIG. 1, the free-standing support body is substantially conical in side elevational view. The rear surface 52 of the free-standing support body 50 is preferably forwardly inclined from the perpendicular at approximately 20 degrees. The front surface 54 includes a back rest portion 64 (see FIG. 3) which is preferably rearwardly inclined from a line perpendicular to the base at approximately 11 degrees. The angle of inclination of the rear surface 52 and the back rest portion 64 are optional, within limits. The back rest portion is preferably not inclined less than 10 nor more than 15 degrees while the rear surface 52 is preferably not inclined less 15 or more than 25 degrees.

Figure 2:
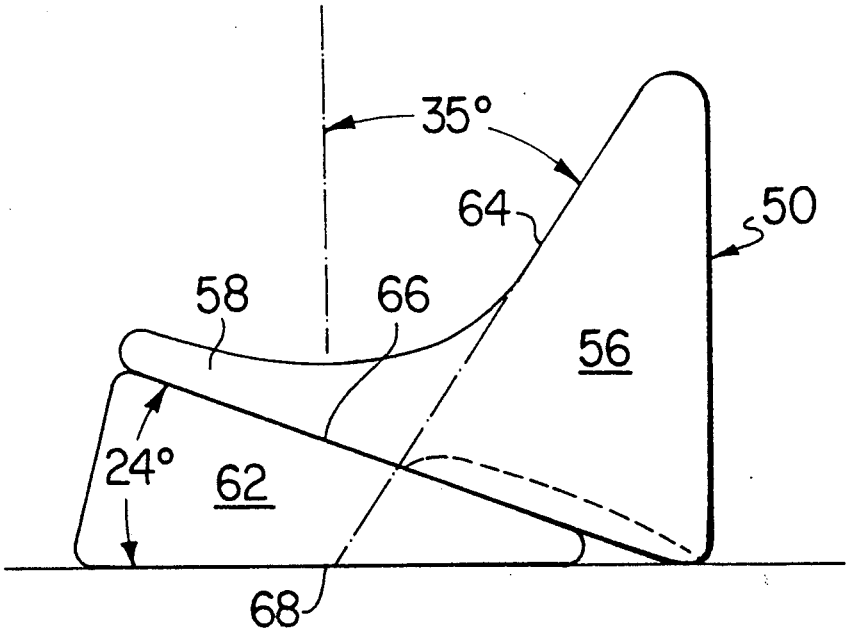
FIG. 2 is a side elevational schematic view of the free-standing support body shown in FIG. 1 in combination with the seat cushion in accordance with the invention, which combination forms an infant seat.
Figure 5:
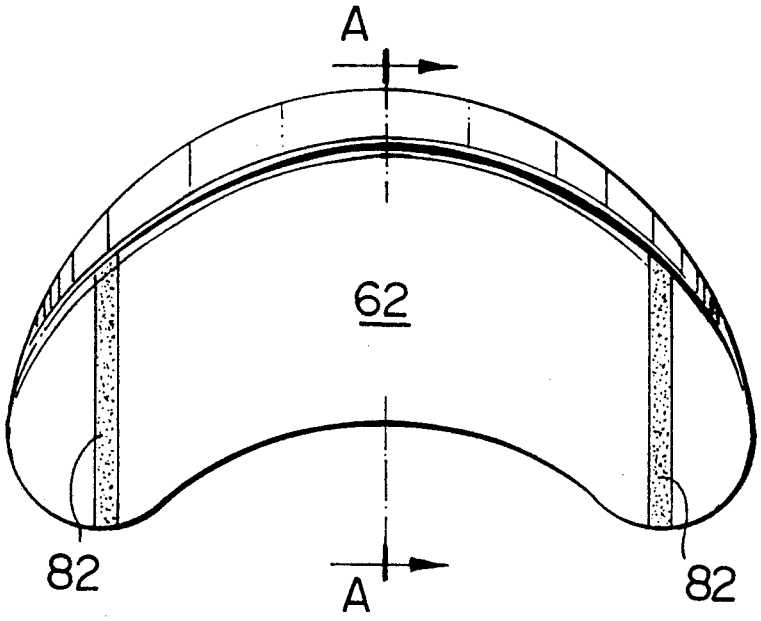
FIG. 5 is a top plan view of the seat cushion in accordance with the invention.

As shown in FIG. 2, the support in accordance with the invention further includes a seat cushion 62 which is substantially triangular in cross-section and longitudinally curved (see FIG. 5). The seat cushion 62 serves the dual purpose of providing a seating surface for an infant when the cushion is secured in the position shown in FIG. 2. It also serves the function of providing a protective cushion for the head and face of an infant learning to sit unaided, as will be explained in relation to FIG. 7. The seat cushion 62 preferably has a top surface 66 which is inclined at an angle of approximately 24 degrees in relation to a bottom surface 68 thereof. As is apparent from FIG. 2, when the seat cushion 62 is secured to the support body it must be in the position shown in FIG. 6, this provides a backrest 64 which is inclined at an angle of 35 degrees from a line perpendicular to a support surface, permitting a child to be seated in a very stable and secure position when the support is configured as shown in FIG. 2.

The free-standing support body 50 and the seat cushion 62 may be constructed from a variety of materials including a shaped plastic foam, an inflatable form made of sheet plastic or a shaped and sewn cloth form which is filled with polyurethane or a polyester fiber or the like. In all cases, the free-standing support body 50 is preferably covered with an outer cover of a sturdy washable material which may be removed as required for cleaning. The seating and protective cushion 62 is likewise conveniently made from a variety of materials but preferably includes a removable outer cover of soft fabric which is readily removed for cleaning as required.

Figure 3:
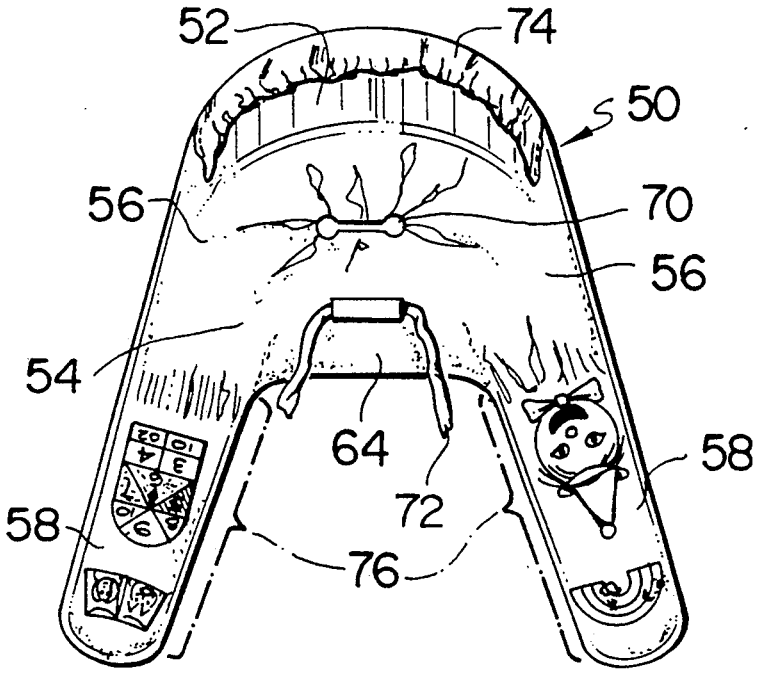
FIG. 3 is a top plan view of the free-standing support body in accordance with the invention.

FIG. 3 shows a top plan view of the free-standing support body in accordance with the invention. The free-standing support body 50 includes a carrying handle 70 which is preferably attached to the apex of the body and is used for moving the free-standing support body 50 from place to place. It further preferably includes a detachable waist strap 72 which is secured to the back rest portion 64 by hook or snap fasteners so that the detachable waist strap can be removed when a child reaches an age that torso support is no longer required. The free-standing support body 50 further preferably includes an elongated pouch 74 which encircles the lower edge of the rear surface 52. The pouch 74 may be zippered along the top edge or simply gathered with a strong elastic cord (not illustrated). It is useful for storing children's toys and other articles related to infant care that are conveniently associated with the infant support. Finally, the forwardly extending arms 58 of the free-standing support body 50 are preferably provided with brightly colored touch and/or sound toys which are incorporated into the fabric covering of the support for providing sensory stimulation for an infant. A variety of such toys may be incorporated into the forwardly extending arms 58. Depictions of animals, toys or T.V.characters, various shapes and sizes of brightly colored material, patches such as velvet, satin and plastic or soft plastic articles such as squeak/or rattle buttons, pockets to explore or flaps to move and such articles for stimulating children while they are supported in a reclined sitting position or learning to sit unsupported on a flat surface. Such articles can likewise be incorporated into the seat cushion 62. Soft loops of fabric or plastic could also be provided for attaching a favorite rattle or ball or cloth covered block or the like. It is important that any toys incorporated into the forwardly extending arms 58 and/or the seating and protective cushion 62 be soft and pliable so as to prevent injury to an infant during inevitable falls.

Figure 4:
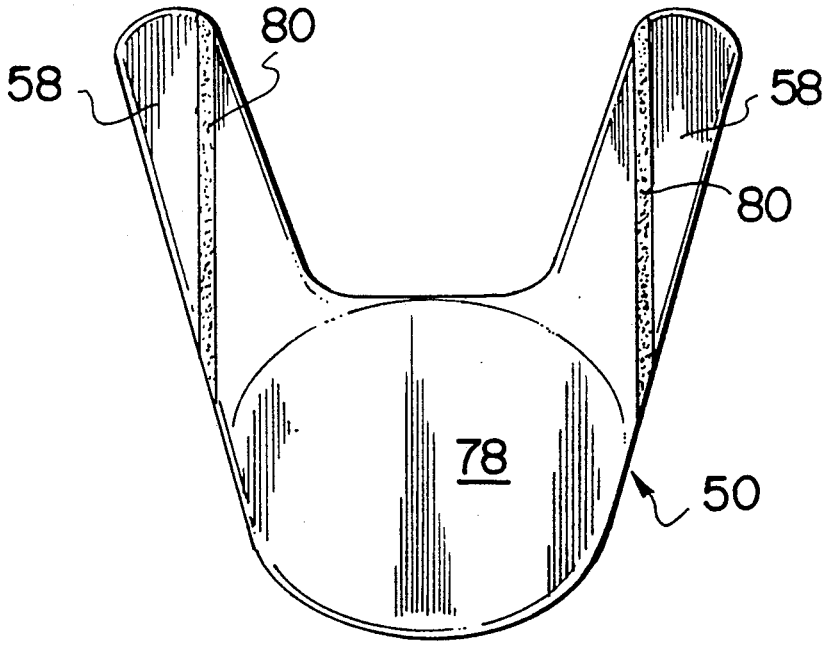
FIG. 4 is a bottom plan view of the free-standing support body in accordance with the invention.

FIG. 4 shows a bottom plan view of the free-standing support body 50 in accordance with the invention. A rear portion 78 of the bottom surface of that body is preferably covered in a slip-resistant material which clings to a variety of surfaces. Certain plastics and rubber coated fabrics are known to be effective in this application. A bottom surface of the forwardly extending arm must also include a means for attaching the free-standing support body 50 to the seat cushion 62. This attachment means is conveniently a longitudinal strip of the hook complement of a hook and loop fastener 80 which is placed on the bottom surface of each forwardly extending arm 58. Other types of fasteners may be substituted, however, the hook portion of a hook and loop fastener is most conveniently used. Such fasteners are available in strips of various widths which may be sewn to the bottom of forwardly extending arms 58 in a location to match complementary loop fasteners 82 attached to the top surface of the seat cushion 62 (see FIG. 5).

As noted above, the seating and protective cushion 62, illustrated in FIG. 5, is preferably covered with a washable soft fabric which is removably attached to the cushion. A top surface of the cushion must include fasteners for attaching the cushion to the free-standing support body 50. Such fasteners are conveniently strips of synthetic loop fastener 82, well known in the art, as such loops are soft, unabrasive, and do not pose a hazard for an infant. Such fasteners are also commonly available in a variety of bright colors so that they add a decorative aspect to the finished seat cushion 62. Seat cushion 62 may be further provided with sewn on, brightly colored fabric patches and/or toys so long as such applications are adequately soft and pliable as to not pose a hazard to an infant which may fall forward on the cushion while learning to sit unaided.

Figure 5A:
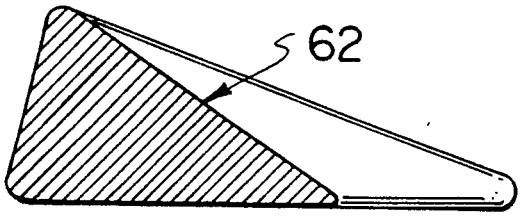
FIG. 5A is a cross-sectional view of the seat cushion taken along line A—A in FIG. 5.
Figure 5B:
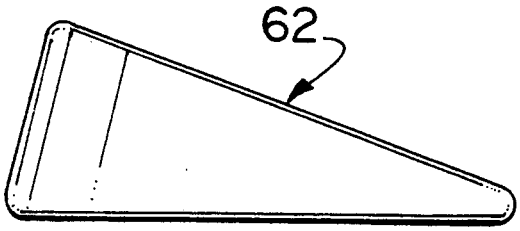
FIG. 5B is a side elevational view of the seat cushion shown in FIG. 5.

As may be seen in FIGS. 5, 5A and 5B, the seat cushion is substantially kidney-shaped in plan view and triangular in cross-section and side elevation.

Figure 6:
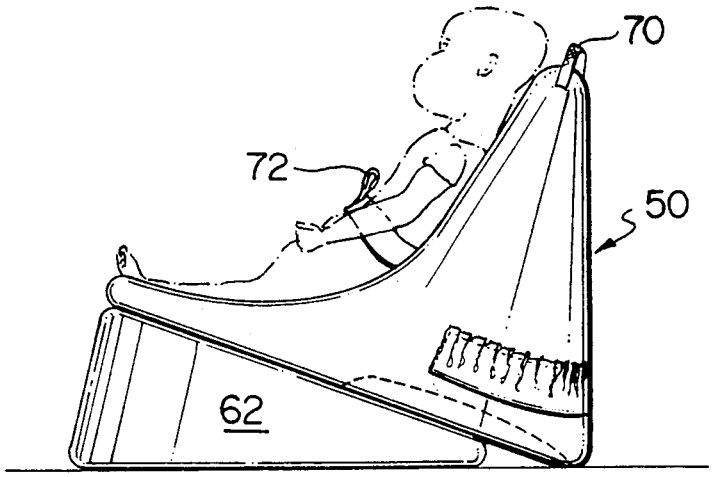
FIG. 6 is a perspective view of an infant in a secure sitting position on the support in accordance with the invention.

The support in accordance with the invention as shown in FIG. 6 is in a configuration for supporting an infant in a secure seated position. In this position, the hook fasteners 80 on the bottom surface of the free-standing support body 50 engage the loop fasteners 82 on the top surface of the seating and protective cushion 62 (see FIG's 4 and 5) to secure the support in a position such that an infant is supported in a semi-reclining position which is adequately reclined that a young infant is unable to disembark the seat. If necessary, the detachable waist strap 72 (see FIG. 3) may be attached about the waist of the infant in order to ensure its safety. This configuration of the support is practical when an infant is tired or too young to sit unaided on a flat surface.

Figure 7:
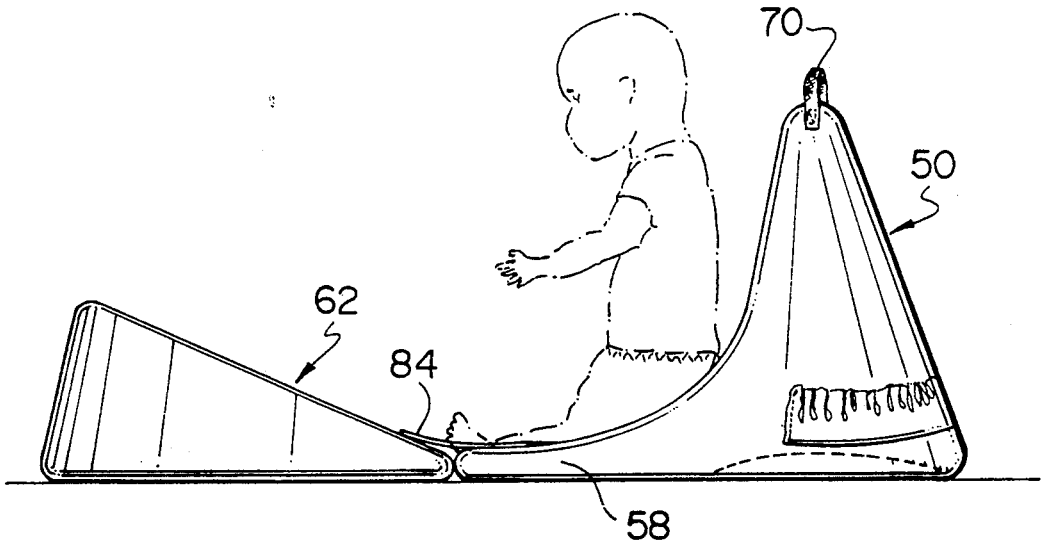
FIG. 7 is a perspective view of an infant in a substantially unsupported sitting position with the secure surround of the support in accordance with the invention.

FIG. 7 shows the support in an alternate configuration for developing balance and motor control in infants. As is apparent, in this position the infant must sit unaided on a flat surface but is provided with a protective surround to cushion the infant from a fall in any direction. The ends of the forwardly extending arms 58 of the free-standing support body 50 are preferably attached to the free-standing support body 50. The hook fastener strap 84 is attached to the loop fastener strips 82 on the seat cushion 62. This prevents the seat cushion 62 from being kicked or otherwise moved away from the seated infant. The seat cushion 62 provides protection for the head and face of an infant who tumbles forward from a sitting position. The forwardly extending arms 58 provide protection for falls to either side and the backrest portion 64 prevents a backwards fall by the sitting infant. The removable waist strap 72 (see FIG. 3) may also be used to help support an infant that is learning to sit on a flat surface. The brightly colored toys 76, etc. provide stimulation and entertainment while the infant is learning muscular control and balance required for sitting unaided on a flat surface.

It is apparent from the above that the support in accordance with the invention for selectively seating and developing balance and motor control in infants provides a versatile support which is useful in the care and training of young children. Once a child has developed to the stage that the protective function of the support is no longer required, the free-standing support body may be used as a back-support by older children while sitting in bed and reading or watching television. It may also be used as a free-standing back rest placed upon the floor, against the wall, etc. for reading, watching television, and the like.

Changes and modifications to the preferred embodiment described above may be made without departing from the scope of the invention which is intending to be limited solely by the scope of the appended claims.

I claim:

1. A support for selectively seating and developing balance and motor control in infants comprising, in combination:

a free-standing support body having a base, front, rear and opposed side surfaces, the front surface including a back rest portion which is inclined at an acute angle with respect tot he base, and spaced-apart side arms which extend forwardly in a plane of the base from opposed sides of the front surface of the support body, said support body further including means for lending weight and stability thereto to inhibit movement of the support body relative to a surface as well as to inhibit tipping of the support body; and a seat cushion which is independent of the support body but attachable thereto in at least a first position wherein the support cushion, in combination with the support body, forms a rearwardly inclined infant seat having a seat surface formed by a top surface of the seat cushion and a backrest surface formed by the backrest portion of the support body, and a second position wherein the seat cushion is remote from the backrest portion to provide a space enclosed at the rear by the backrest portion of the support body, on the sides by the opposed side arms, and at the front by the seat cushion, said space being adequate to accommodate an infant in a substantially unsupported sitting position for developing balance and motor control while providing a surrounding cushion to help prevent injury from a fall in any direction.

2. A support as recited in claim 1 wherein the back rest portion is rearwardly inclined at an angle of 11–15 degrees with respect to a line which is perpendicular to the plane of the base.

3. The support as recited in claim 2 wherein the seat cushion is substantially triangular in cross-section and has a flat base and a top surface which is inclined at an angle of 19–24 degrees with respect to a plane of the base so that the cushion in the first position, in combination with the support body, provides an infant seat having a back rest which is inclined at an angle of approximately 35 degrees with respect to a line that is perpendicular to a surface on which the seat cushion and the support body rests.

4. The support as recited in claim 3 wherein the seat cushion is substantially kidney-shaped in plan view.

5. The support as recited in claim 1 wherein the side arms are provided with soft pliable toy articles which are affixed to or integral with a top surface of those side arms for providing an infant with sensory stimulation and entertainment.

6. The support as recited in claim 1 wherein the support body and the seat cushion are covered with a fabric which may be removed for cleaning.

7. A support for selectively seating and developing balance and motor control in infants comprising, in combination:

a free-standing support body having a base, front, rear and opposed side surfaces, the front surface including a back rest portion which is inclined at an acute angle with respect to the base, and spaced-apart side arms which extend forwardly in a plane of the base from opposed sides of the front surface of the support body, said support body further including means for lending weight and stability thereto to inhibit movement of the support body relative to a surface as well as to inhibit tipping of the support body; and a seat cushion which is substantially triangular in cross-section said seat cushion being independent of the support body but attachable thereto in at least a first position wherein the support cushion, in combination with the support body, forms a rearwardly inclined infant seat having a seat surface formed by a top surface of the seat cushion and a backrest surface formed by the backrest portion of the support body, and a second position wherein the seat cushion is remote from the backrest portion to provide a space enclosed at the rear by the backrest portion of the support body, on the sides by the opposed side arms, and at the front by the seat cushion, said space being adequate to accommodate an infant in a substantially unsupported sitting position for developing balance and motor control while providing a surrounding cushion to help prevent injury from a fall in any direction.

8. A support as recited in claim 7 wherein the back rest portion is rearwardly inclined at an angle of 11–15 degrees with respect to a line which is perpendicular to the plane of the base.

9. The support as recited in claim 8 wherein the seat cushion has a flat base and a top surface which is inclined at an angle of 19–24 degrees with respect to a plane of the base so that the cushion in the first position, in combination with the support body, provides an infant seat having a back rest which is inclined at an angle of approximately 35 degrees with respect to a line that is perpendicular to a surface on which the seat cushion and the support body rests.

10. The support as recited in claim 9 wherein the seat cushion is substantially kidney-shaped in plan view.

11. The support as recited in claim 7 wherein the side arms are provided with soft pliable toy articles which are affixed to or integral with a top surface of those side arms for providing an infant with sensory stimulation and entertainment.

12. The support as recited in claim 7 wherein the support body and the seat cushion are covered with a fabric which may be removed for cleaning.

* * * * *